United States Patent [19]

Reitzel

[11] 3,955,726

[45] May 11, 1976

[54] CONTACT LENS LOCKET

[76] Inventor: Helen Reitzel, 660 Mariposa Ave., Mountain View, Calif. 94040

[22] Filed: July 3, 1974

[21] Appl. No.: 485,497

[52] U.S. Cl. ..... 224/5 R; 224/27; 206/5.1; 63/19

[51] Int. Cl.[2] ..... A45C 11/04

[58] Field of Search ..... 224/27, 26 R, 26 B, 224/26 K, 26 E, 28 R, 28 B, 5 R; 63/19, 18, 17, 1 R; 206/5.1

[56] References Cited

UNITED STATES PATENTS

| | | | |
|---|---|---|---|
| 152,197 | 6/1874 | Wachter | 63/19 X |
| 1,205,546 | 11/1916 | Kendall | 63/19 X |
| 1,609,481 | 12/1926 | McCarthy et al. | 224/28 B |
| 3,089,500 | 5/1963 | Stalcup | 206/5.1 UX |
| 3,211,281 | 10/1965 | Speshyock et al. | 206/5.1 |

*Primary Examiner*—Robert J. Spar
*Assistant Examiner*—Jerold M. Forsberg
*Attorney, Agent, or Firm*—Boone, Schatzel & Hamrick

[57] ABSTRACT

A combined decorative and contact lens storage locket is disclosed. The contact lens locket has at least one compartment in which is mounted a sub-housing made of inert material for storing the contact lenses in their normal storage solution. The door to the compartment may also comprise a mirror. In an alternate embodiment, the contact lens locket is comprised of two compartments with the door for each compartment having a cavity. In the cavity of one door the sub-housing for storing the contact lenses is mounted. In the cavity of the other door a holder for receiving a vial of wetting solution for use with the contact lenses is provided. The two doors to the locket, when open, provide a stand for holding the locket in an upright position. The inside of the locket contains a mirror in one or both of the compartments. Alternately, one of the mirrors or both may be magnifying in nature.

5 Claims, 5 Drawing Figures

Fig_1
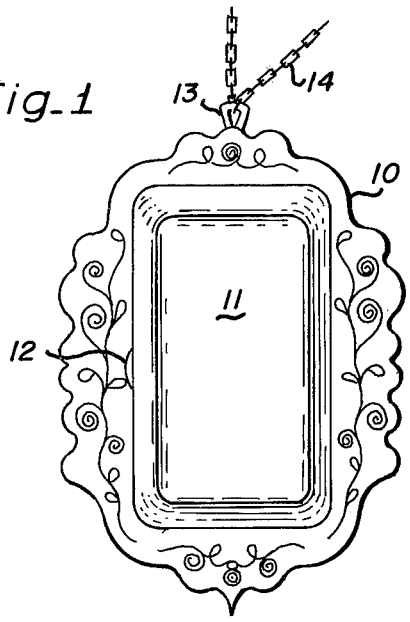
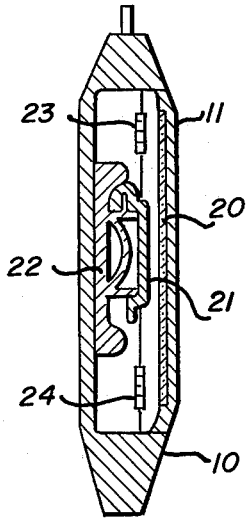
Fig_2
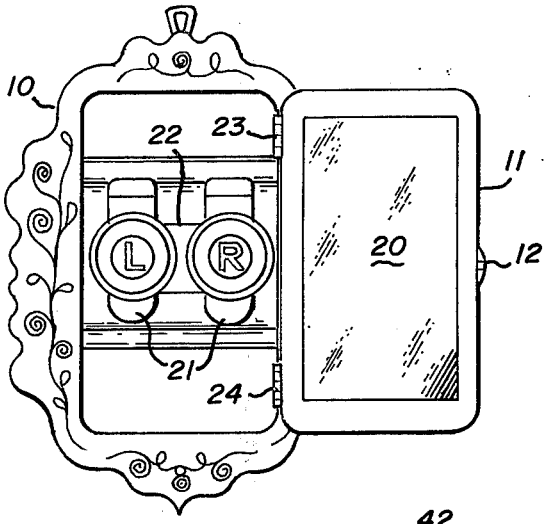
Fig_3
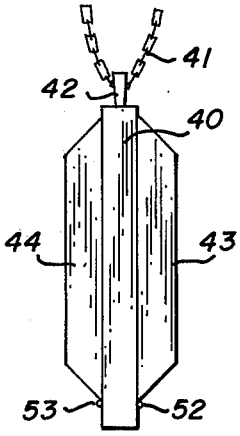
Fig_4
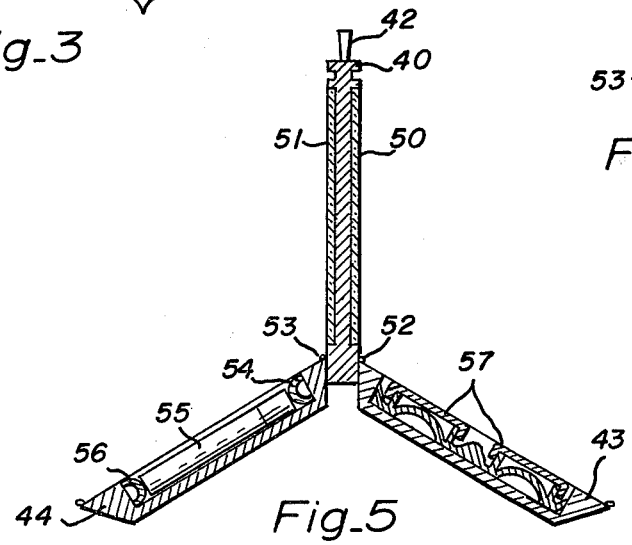
Fig_5

CONTACT LENS LOCKET

BACKGROUND OF THE INVENTION

1. Field of the Invention

This invention relates to a decorative and contact lens storage locket for providing a decorative storage means for storing contact lenses.

2. Description of the Prior Art

One inherent disadvantage of wearing contact lenses is that a contact lens can easily be lost. Many users of contact lenses therefore carry a spare pair of contact lenses with them so as to eliviate any danger that might arise from the loss of one or both contact lenses.

There are many contact lens cases for storing contact lenses in the art. These are examplified by U.S. Pat. No. 2,887,779 entitled "Case for Contact Lenses"; U.S. Pat. No. 3,314,533 entitled "Lens Containing and Dispersing Device" and Canadian Pat. No. 607642 entitled "Support and Protective Recepticle for Contact Lenses".

Lockets having a plurality of compartments is well known in the art as examplified in U.S. Pat. No. 2,545,267 entitled "Locket Construction".

Lockets have also been used to carry such things as toys, as examplified by U.S. Pat. No. 3,686,894 and for carrying a vial of perfume as described in U.S. Pat. No. 2,751,764.

SUMMARY OF THE PRESENT INVENTION

An object of this invention is to provide a new and novel combination of a decorative and contact lens locket in which the contact lens may be stored.

Another object of the invention is to provide a new and novel contact lens locket that contains a storage compartment for the contact lenses, a mirror for use in removing and inserting the contact lenses and a vial of wetting solution to be used during the insertion process.

Another object of the invention is to provide a new and novel contact lens locket wherein the doors of the locket when open form a stand for the locket such that the locket need not be held by the user during the insertion or removal of contact lenses.

Briefly, the invention relates to a combined decorative and contact lens storage locket. A locket is provided which has at least one compartment. Within that compartment there is mounted a sub-housing for storing the contact lenses. The sub-housing has a cover which forms a water tight seal such that the contact lenses may be stored in their normal storing solution. The sub-housing and its cover are made of inert material such that the material will not react with the normal storing solution used with the contact lenses. Within the door of the locket, a mirror is placed to be used during the insertion and removal of contact lenses by the wearer. A second embodiment is shown wherein the decorative locket has two compartments Within the doors for each of the compartments there is a cavity. Within one cavity the sub-housing for storing the contact lenses is mounted and in the cavity of the other door, a holder for receiving a vial containing wetting solution is provided,. A mirror is placed in either one or both of the compartments of the locket itself. One of the mirrors may be magnifying. The two doors when opened, form a stand for the locket such that the mirrors may be used by the user without holding the locket in his hand.

An advantage of this invention is that it allows the users to carry with them a contact lens storage means that is decorative and which does not require that it be carried within ones pocket or purse.

Another advantage of the constant lens locket is that it allows the user to carry a spare pair of contact lenses with him or to carry a contact lens storage container with him in situations which otherwise would preclude such action. For example, the locket can be designed to be worn with swim gear or with other styles of dress both for men and women which would otherwise prohibit the carrying of prior art contact lens storage containers.

The foregoing and other objects, features and advantages of the invention will be apparent from the following, more particular description of the preferred embodiments of the invention as illustrated in the accompanying drawings.

IN THE DRAWING

FIG. 1 shows a front view of a contact lens locket of the invention.

FIG. 2 shows a cross-section side view of the contact lens locket of FIG. 1.

FIG. 3 shows the contact lens sub-housing within the compartment of the contact lens locket of FIG. 1.

FIG. 4 shows a side view of a contact lens locket having two compartments.

FIG. 5 is a cross-section of the contact lens locket of FIG. 4 with the doors open showing the location of the contact lens storage sub-housing and the vial holder.

DETAILED DESCRIPTION OF THE PREFERRED EMBODIMENTS

FIG. 1 shows a contact lens locket being comprised of a main housing 10 having door 11 forming the compartment of the locket. An eyelet 13 is provided by which a suitable locket chain 14 may pass such that the locket might be hung about the neck. Door 11 has an indentation 12 to allow the door to be opened in a standard fashion. The exterior of the contact lens locket is decorative in nature and can be of any size or shape and have any decorative design desired. Further the material used for the lockets themselves, can be of any suitable type material including any metals and/or plastics.

FIG. 2 shows the internal structure of the contact lens locket of FIG. 1. Within the contact lense locket there is mounted a sub-housing 22 with its associated cover 21 which forms the contact lens storage container. The shape of the contact lens container is that normally found within the state of the art. The contact lens container is made of inert material so as not to interact with the storage solution used to store contact lenses. The sub-housing 22 and its associated cover 21 form a water tight enclosure such that the contact lenses may be stored in their storage solution. Hinges 23 and 24 are provided for opening the door 11 of the locket. Mirror 20 is mounted to the innerside of door 11 to become exposed when the door is open.

FIG. 3 shows the contact lens locket of FIG. 1 with the door open. It can be seen within the main housing structure 10 there is a cavity which houses a sub-housing 22 having compartments for storing the left and right contact lens. Sub-housing 22 is mounted in the locket by means of an appropriate glue, cement or adhesive. The cavity in structure 10 is large enough for securing and storing therein a vial of wetting solution.

Mirror 20 is again shown to be located on the inside of the cover 11 of the contact lens locket. The locket door 11 is held in a closed fashion by snap locks that are common within the art.

An alternative structure is shown in FIG. 4 for the contact lens locket. Here the contact lens locket is comprised of two compartments having main housing 40 and doors 43 and 44. Again, an eyelet 42 is provided through which an appropriate chain 41 might pass.

FIG. 5 shows a cross-section view of the location of the components of the contact lens locket of FIG. 4. Door 43 has an inner cavity of sufficient depth such that the sub-housing 57 may be mounted within it for storing the contact lenses. The sub-housing 57 is the same as the sub-housing 22 as shown in FIG. 3 and is made of the same material.

Within door 44 there is an internal cavity which is provided with spring mounts 54 and 56. The spring mounts will hold a vial 55 of wetting solution within the cavity of door 44. Hinges 52 and 53 connect doors 43 and 44 to the main locket structure 40. Main structure 40 has two cavities, one on each side. In one cavity a mirror 50 is mounted and in the other cavity a mirror 51 is mounted. Again mirrors 51 and 50 and sub-housing are held in their respective positions by an appropriate cement, glue or adhesive. One of the mirrors 50 or 51 may be magnifying in nature so as to aid the user in inserting or extracting the contact lenses from the eye.

Doors 43 and 44 are so shaped that when they are opened they will provide a stand for the locket such that it will stand upright without being held by the hand. This is again to allow the user the ability of using the mirrors contained within the contact lens locket without holding the locket.

The hinges 52 and 53 can be of the friction type such that the doors 43 and 44 will be freely moved. The hinges have sufficient stiffness to allow the doors to be opened to varying degrees whereby the mirror may be tilted to a desired angle by selecting the degree to which the doors are open with relationship to each other.

While the invention has been particularly shown and described with reference to preferred embodiments thereof, it would be understood by those skilled in the art that various changes in form and detail may be made therein without departing from the spirit and scope of the invention.

What is claimed is:

1. A locket comprising:

an ornamental housing having a first recessed surface formed in one side thereof and a second recessed surface formed in an opposite side thereof;

a first door having a first cavity and hingedly affixed to said housing to cover said first surface and form a first closeable compartment;

a second door having a second cavity and hingedly affixed to said housing to cover said second surface and form a second closeable compartment, said first and second doors when open forming a stand for supporting the locket;

a sub-housing mounted within said first compartment and forming a third cavity for storing contact lenses, the material of said sub-housing being inert so as not to interact with the liquid preparation generally used to store contact lenses; and a cover means of the same material as said sub-housing and adapted to mate with said sub-housing to form a water-tight container for the contact lenses.

2. A locket as recited in claim 1 and further comprising: means forming an eyelet affixed to said housing for receiving means for suspending the locket to the person of a wearer.

3. A locket as recited in claim 1 wherein said second door includes means disposed within said second cavity for holding a vial of wetting solution within said second compartment.

4. A locket as recited in claim 1 and further comprising a first mirror mounted to said first surface and a second mirror mounted to said second surface, said first and second mirrors being exposed when said doors are open.

5. A locket as recited in claim 4 wherein one of said first and second mirrors is a magnifying mirror.

* * * * *